US007134656B2

(12) United States Patent
Terao et al.

(10) Patent No.: US 7,134,656 B2
(45) Date of Patent: Nov. 14, 2006

(54) ANGLED STANDBY TRAY FOR POST-PROCESS DEVICE

(75) Inventors: Yasunobu Terao, Shizuoka-ken (JP); Tokihiko Ise, Shizuoka-ken (JP); Hajime Yamamoto, Shizuoka-ken (JP); Reiji Murakami, Kanagawa-ken (JP); Hiroyuki Taki, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/085,241

(22) Filed: Mar. 22, 2005

(65) Prior Publication Data

US 2006/0066037 A1 Mar. 30, 2006

(30) Foreign Application Priority Data

Sep. 29, 2004 (JP) ..... 2004-285286
Dec. 28, 2004 (JP) ..... 2004-381906

(51) Int. Cl.
*B65H 37/04* (2006.01)

(52) U.S. Cl. ..... 270/58.14; 270/58.18; 270/58.08; 270/58.11; 399/410

(58) Field of Classification Search ..... 270/58.08, 270/58.11, 58.12, 58.13, 58.14, 58.18; 399/410, 399/189, 190, 191; 271/189, 190, 191, 192
See application file for complete search history.

(56) References Cited

U.S. PATENT DOCUMENTS 4,473,425 A 9/1984 Baughman et al.
4,611,741 A 9/1986 Wilson
4,794,859 A 1/1989 Huseby et al.
4,898,374 A 2/1990 Vermaat
5,098,074 A 3/1992 Mandel et al.
5,282,611 A 2/1994 Ueda et al.
5,285,249 A 2/1994 Mahoney
5,289,251 A 2/1994 Mandel et al.
5,435,544 A 7/1995 Mandel
5,451,037 A 9/1995 Lundstrom
5,628,502 A * 5/1997 Amarakoon ..... 270/58.07
5,676,517 A 10/1997 Lotz
5,709,376 A 1/1998 Ushirogata
5,934,140 A 8/1999 Jackson et al.
5,961,274 A 10/1999 Bors
5,971,384 A 10/1999 Asao
6,065,747 A 5/2000 Khovaylo et al.
6,092,948 A 7/2000 Altfather (Continued)

FOREIGN PATENT DOCUMENTS

JP 62-008965 A 1/1987

(Continued)

OTHER PUBLICATIONS

U.S. Appl. No. 11/085,247, filed Mar. 22, 2005, Terao et al.

(Continued)

*Primary Examiner*—Patrick Mackey
(74) *Attorney, Agent, or Firm*—Foley & Lardner LLP

(57) ABSTRACT

Above a processing tray, a standby tray for making sheets of paper P stand by is installed. The sheets of paper P on the standby tray are dropped, fed, and moved to the processing tray, thus the conveying path from the standby tray to the processing tray is shortened. The standby tray is given a tilt angle of θ1 and the consistency is improved by the own weight of the sheets. A first and a second paper ejection tray are given a tilt angle of θ2 and the consistency is improved by the own weight of the sheets or a sheet bundle.

7 Claims, 11 Drawing Sheets

U.S. PATENT DOCUMENTS

| | | | | |
|---|---|---|---|---|
| 6,231,039 | B1 | 5/2001 | Chung | |
| 6,330,999 | B1 * | 12/2001 | Coombs et al. | 270/58.18 |
| 6,336,630 | B1 | 1/2002 | Holtman et al. | |
| 6,354,059 | B1 | 3/2002 | Yoshie et al. | |
| 6,450,934 | B1 | 9/2002 | Coombs | |
| 6,641,129 | B1 | 11/2003 | Ogita et al. | |
| 6,671,492 | B1 | 12/2003 | Mimura et al. | |
| 6,698,744 | B1 | 3/2004 | Yamada et al. | |
| 6,712,349 | B1 | 3/2004 | Watanabe | |
| 6,722,646 | B1 | 4/2004 | Sekiyama et al. | |
| 6,733,006 | B1 | 5/2004 | Kobayashi et al. | |
| 6,819,906 | B1 | 11/2004 | Herrmann et al. | |
| 6,824,128 | B1 | 11/2004 | Nagata et al. | |
| 6,910,686 | B1 | 6/2005 | Awano | |
| 6,928,259 | B1 | 8/2005 | Sakuma | |
| 2002/0047233 | A1 | 4/2002 | Coombs et al. | |
| 2002/0163119 | A1 | 11/2002 | Kawata | |
| 2004/0113348 | A1 | 6/2004 | Awano | |
| 2004/0126163 | A1 | 7/2004 | Asami et al. | |
| 2005/0000336 | A1 | 1/2005 | Hattori et al. | |

FOREIGN PATENT DOCUMENTS

| | | | |
|---|---|---|---|
| JP | 04-312894 | A | 11/1992 |
| JP | 06-099070 | B2 | 12/1994 |
| JP | 2001-089009 | A | 4/2001 |
| JP | 2003-081517 | A | 3/2003 |
| JP | 2004-142868 | A | 5/2004 |

OTHER PUBLICATIONS

U.S. Appl. No. 11/085,226, filed Mar. 22, 2005, Terao et al.
U.S. Appl. No. 11/085,248, filed Mar. 22, 2005, Terao et al.
U.S. Appl. No. 11/085,227, filed Mar. 22, 2005, Terao et al.
U.S. Appl. No. 11/085,244, filed Mar. 22, 2005, Terao et al.
U.S. Appl. No. 11/085,243, filed Mar. 22, 2005, Terao et al.
U.S. Appl. No. 11/085,242, filed Mar. 22, 2005, Terao et al.
U.S. Appl. No. 11/085,250, filed Mar. 22, 2005, Terao et al.
U.S. Appl. No. 11/085,240, filed Mar. 22, 2005, Terao et al.
U.S. Appl. No. 11/008,247, filed Dec. 10, 2004, Terao et al.
U.S. Appl. No. 11/008,248, filed Dec. 10, 2004, Terao et al.
U.S. Appl. No. 11/008,222, filed Dec. 10, 2004, Terao et al.
U.S. Appl. No. 11/008,381, filed Dec. 10, 2004, Terao et al.
U.S. Appl. No. 11/008,132, filed Dec. 10, 2004, Terao et al.
U.S. Appl. No. 11/008,131, filed Dec. 10, 2004, Terao et al.
U.S. Appl. No. 11/008,142, filed Dec. 10, 2004, Terao et al.
U.S. Appl. No. 11/008,199, filed Dec. 10, 2004, Terao et al.
U.S. Appl. No. 11/008,145, filed Dec. 10, 2004, Terao et al.
U.S. Appl. No. 11/008,124, filed Dec. 10, 2004, Terao et al.
U.S. Appl. No. 11/008,350, filed Dec. 10, 2004, Terao et al.
U.S. Appl. No. 11/008,147, filed Dec. 10, 2004, Terao et al.
U.S. Appl. No. 11/008,148, filed Dec. 10, 2004, Terao et al.
U.S. Appl. No. 11/008,349, filed Dec. 10, 2004, Terao et al.
U.S. Appl. No. 11/008,294, filed Dec. 10, 2004, Terao et al.
U.S. Appl. No. 11/008,224, filed Dec. 10, 2004, Terao et al.
U.S. Appl. No. 11/008,230, filed Dec. 10, 2004, Terao et al.
U.S. Appl. No. 11/008,290, filed Dec. 10, 2004, Terao et al.
U.S. Appl. No. 11/008,392, filed Dec. 10, 2004, Terao et al.
U.S. Appl. No. 11/008,299, filed Dec. 10, 2004, Terao et al.
U.S. Appl. No. 11/008,257, filed Dec. 10, 2004, Terao et al.
U.S. Appl. No. 11/008,271, filed Dec. 10, 2004, Terao et al.
U.S. Appl. No. 11/008,295, filed Dec. 10, 2004, Terao et al.
U.S. Appl. No. 11/008,251, filed Dec. 10, 2004, Terao et al.
K. Sasahara et al., U.S. PTO Office Action, U.S. App. No. 11/008,122, filed Apr. 19, 2006, 10 pages.
Y. Terao et al., Notice of Allowance and Fee(s) Due, U.S. Appl. No. 11/008,199, filed Apr. 20, 2006, 15 pages.
Y. Terao et al., Notice of Allowance and Fee(s) Due, U.S. Appl. No. 11/008,247, filed May 1, 2006, 16 pages.
Y. Terao et al., Notice of Allowance and Fee(s) Due, U.S. Appl. No. 11/008,349, filed May 2, 2005, 9 pages.
Y. Terao et al., U.S. PTO Office Action, U.S. Appl. No. 11/008,224, filed Apr. 21, 2006, 12 pages.
Y. Terao et al., U.S. PTO Office Action, U.S. Appl. No. 11/008,257, filed Apr. 28, 2006, 13 pages.
Y. Terao et al., U.S. PTO Office Action, U.S. Appl. No. 11/008,271, filed Apr. 25, 2006, 14 pages.
Y. Terao et al., U.S. PTO Office Action, U.S. Appl. No. 11/008,294, filed May 5, 2006, 13 pages.
Y. Terao et al., U.S. PTO Office Action, U.S. Appl. No. 11/008,299, filed May 5, 2006, 12 pages.
Y. Terao et al., U.S. PTO Office Action, U.S. Appl. No. 11/008,392, filed Apr. 26, 2006, 10 pages.
U.S. Appl. No. 11/008,122, filed Dec. 10, 2004, Sasahara.
U.S. Appl. No. 11/008,567, filed Dec. 10, 2004, Terao et al.
U.S. Appl. No. 11/085,251, filed Mar. 22, 2005, Ilzuka et al.
U.S. Appl. No. 11/085,256, filed Mar. 22, 2005, Terao et al.
U.S. Appl. No. 11/085,257, filed Mar. 22, 2005, Terao et al.
U.S. Appl. No. 11/085,264, filed Mar. 22, 2005, Terao et al.
U.S. Appl. No. 11/085,625, filed Mar. 22, 2005, Terao et al.
Y. Terao et al., Notice of Allowance and Fee(s) Due, U.S. Appl. No. 11/008,132, filed Oct. 6, 2005, 9 pages.
Y. Terao et al., U.S. PTO Notice of Allowance, U.S. Appl. No. 11/085,243, filed Jan. 5, 2006, with attached Notice of Withdrawal from Issue dated Jan. 10, 2006, 10 pgs.
Y. Terao et al., U.S. PTO Office Action, U.S. Appl. No. 11/008,122, filed Nov. 21, 2005, 9 pages.
Y. Terao et al., U.S. PTO Office Action, U.S. Appl. No. 11/008,131, filed Feb. 23, 2006, 9 pgs.
Y. Terao et al., U.S. PTO Office Action, U.S. Appl. No. 11/008,148, filed Jan. 11, 2006, 12 pages.
Y. Terao et al., U.S. PTO Office Action, U.S. Appl. No. 11/008,222, filed Feb. 24, 2006, 12 pgs.
Y. Terao et al., U.S. PTO Office Action, U.S. Appl. No. 11/008,224, filed Nov. 21, 2005, 9 pages.
Y. Terao et al., U.S. PTO Office Action, U.S. Appl. No. 11/008,230, filed Feb. 24, 2006, 11 pgs.
Y. Terao et al., U.S. PTO Office Action, U.S. Appl. No. 11/008,251, filed Jan. 13, 2006, 11 pages.
Y. Terao et al., U.S. PTO Office Action, U.S. Appl. No. 11/008,257, filed Nov. 30, 2005, 9 pages.
Y. Terao et al., U.S. PTO Office Action, U.S. Appl. No. 11/008,271, filed Nov. 30, 2005, 9 pages.
Y. Terao et al., U.S. PTO Office Action, U.S. Appl. No. 11/008,290, filed Nov. 30, 2005, 9 pages.
Y. Terao et al., U.S. PTO Office Action, U.S. Appl. No. 11/008,295, filed Jan. 5, 2006, 11 pages.
Y. Terao et al., U.S. PTO Office Action, U.S. Appl. No. 11/008,350, filed Jan. 26, 2006, 12 pages.
Y. Terao et al., U.S. PTO Office Action, U.S. Appl. No. 11/008,392, filed Dec. 14, 2005, 9 pages.
Y. Terao et al., U.S. PTO Office Action, U.S. Appl. No. 11/085,226, filed Jan. 13, 2006, 9 pgs.
Y. Terao et al., U.S. PTO Office Action, U.S. Appl. No. 11/085,227, filed Feb. 9, 2006, 9 pgs.
Y. Terao et al., U.S. PTO Office Action, U.S. Appl. No. 11/085,240, filed Jan. 26, 2006, 8 pgs.
Y. Terao et al., U.S. PTO Office Action, U.S. Appl. No. 11/085,243, filed Jan. 26, 2006, 6 pgs.
Y. Terao et al., U.S. PTO Office Action, U.S. Appl. No. 11/085,244, filed Feb. 9, 2006, 7 pgs.
Y. Terao et al., U.S. PTO Office, U.S. Appl. No. 11/008,294, filed Dec. 13, 2005, 9 pages.
Y. Terao et al., U.S. PTO Office, U.S. Appl. No. 11/008,299, filed Dec. 13, 2005, 9 pages.
Y. Terao et al., U.S. PTO Office, U.S. Appl. No. 11/008,349, filed Dec. 13, 2005, 9 pages.
Y. Terao et al., U.S. PTO Office, U.S. Appl. No. 11/008,567, filed Dec. 13, 2005, 9 pages.
Y. Terao, et al., Notice of Allowance and Fee(s) Due, U.S. Appl. No. 11/008,124, filed Sep. 30, 2005, 9 pages.
Y. Terao et al., Notice of Allowance and Fee(s) Due, U.S. Appl. No. 11/008,148, filed Jun. 26, 2006, 10 pages.

Y. Terao et al., Notice of Allowance and Fee(s) Due, U.S. Appl. No. 11/008,251, filed Jun. 26, 2006, 10 pages.
Y. Terao et al., Notice of Allowance and Fee(s) Due, U.S. Appl. No. 11/085,243, filed Jun. 26, 2006, 10 pages.
Y. Terao et al., U.S. PTO Office Action, U.S. Appl. No. 11/008,132, filed Jun. 9, 2006, with attached Notice of Withdrawal from issue dated May 30, 2006, 11 pgs.
Y. Terao et al., U.S. PTO Office Action, U.S. Appl. No. 11/008,295, filed Jun. 23, 2006, 14 pgs.
Y. Terao et al., Notice of Allowance and Fee(s) Due, U.S. Appl. No. 11/085,244, filed Jul. 13, 2006, 10 pages.
Y. Terao et al., U.S. PTO Office Action, U.S. Appl. No. 11/008,145, filed Jun. 30, 2006, 6pgs.
Y. Terao et al., U.S. PTO Office Action, U.S. Appl. No. 11/088,147, filed Jul. 7, 2006, 4 pgs.
Y. Terao et al., U.S. PTO Office Action, U.S. Appl. No. 11/008,290, filed Jul. 21, 2006, 15 pgs.
Y. Terao et al., U.S. PTO Office Action, U.S. Appl. No. 11/008,350, filed Jul. 6, 2006, 12 pgs.
Y. Terao et al., U.S. PTO Office Action, U.S. Appl. No. 11/085,226, filed Jul. 20, 2006, 12 pages.
Y. Terao et al., U.S. PTO Office Action, U.S. Appl. No. 11/085,227, filed Aug. 11, 2006, 15 pages.
Y. Terao et al., U.S. PTO Office Action, U.S. Appl. No. 11/085,240, filed Aug. 2, 2006, 15 pages.
Y. Terao et al., U.S. PTO Office Action, U.S. Appl. No. 11/085,247, filed Jul. 13, 2006, 14 pgs.
Y. Terao et al., U.S. PTO Office Action, U.S. Appl. No. 11/085,248, filed Jul. 5, 2006, 15 pgs.
Y. Terao et al., U.S. PTO Office Action, U.S. Appl. No. 11/085,256, filed Jul. 13, 2006, 13 pgs.
Y. Terao et al., U.S. PTO Office Action, U.S. Appl. No. 11/085,625, filed Jul. 28, 2006, 13 pgs.
Y. Terao, et al., Notice of Allowance and Fee(s) Due, U.S. Appl. No. 11/008,122, filed Jul. 26, 2006, 8 pgs.
Y. Terao et al., Notice of Allowance and Fee(s) Due, U.S. Appl. No. 11/008,392, filed Sep. 15, 2006, 10 pages.
Y. Terao et al., U.S. PTO Office Action, U.S. Appl. No. 11/008,381, filed Aug. 23, 2006, 17 pages.
Y. Terao et al., U.S. PTO Office Action, U.S. Appl. No. 11/008,567, filed Aug. 21, 2006, 14 pages.
Y. Terao, et al., Notice of Allowance and Fee(s) Due, U.S. Appl. No. 11/008,222, Aug. 31, 2006, 12 pgs.
Y. Terao, et al., Notice of Allowance and Fee(s) Due, U.S. Appl. No. 11/008,299, Sep. 6, 2006, 9 pgs.

* cited by examiner

ANGLED STANDBY TRAY FOR POST-PROCESS DEVICE

CROSSREFERENCE TO RELATED APPLICATION

This application is based upon and claims the benefit of priority from prior Japanese Patent Application Nos. 2004-285286 filed on Sep. 29, 2004 and 2004-381906 filed on Dec. 28, 2004, the entire contents of which are incorporated herein by reference.

BACKGROUND OF THE INVENTION

1. Field of the Invention

The present invention relates to a sheet post-process apparatus for post-processing sheets of paper ejected from an image forming apparatus such as a copier, a printer, or a composite device.

2. Description of the Related Art

In recent years, in an image forming apparatus, to post-process sheets of paper after image forming such as sorting or stapling sheets of paper, a sheet post-process apparatus may be installed in the neighborhood of the paper ejection unit of the image forming apparatus body. To make the succeeding sheets ejected from the image forming apparatus body stand by like this, conventionally, in Japanese Patent Publication 6-99070, an apparatus installing a shifting path halfway the path toward the stapler is disclosed. Or, in Japanese Patent Application 2004-142868, an apparatus having an installed primary loading section above a paper ejection tray to match sheets of paper at the time of paper ejection after the sheets are processed.

However, as in the conventional apparatus, when a shifting path or a buffer path is installed halfway the path toward the stapler, the length of the conveying path from the paper ejection unit of the image forming apparatus body to the stapler becomes longer, thus a problem arises that miniaturization of the apparatus is disturbed.

Therefore, a sheet post-process apparatus capable of shortening the distance from the paper ejection unit of the image forming apparatus to the processing mechanism for performing the post process and realizing miniaturization is desired.

SUMMARY OF THE INVENTION

An object of this embodiment of the present invention is to provide a sheet post-process apparatus for shortening the distance from the paper ejection unit of the image forming apparatus to the processing mechanism for performing the post process and realizing miniaturization.

According to this embodiment of the present invention, the sheet post-process apparatus comprises a standby tray for making sheets ejected from an image forming apparatus stand by and having a tilt angle of θ1 at which the front ends of the sheets are higher than the rear ends of the sheets, a processing tray arranged under the standby tray for loading the sheets dropped and fed from the standby tray and/or the sheets ejected from the image forming apparatus not via the standby tray, a processing mechanism for post-processing the sheets loaded on the processing tray, and a paper ejection tray for at least loading the sheets after post processed to be ejected from the processing tray and having a tilt angle of θ2 at which the front ends of the sheets are higher than the rear ends of the sheets.

DETAILED DESCRIPTION OF THE INVENTION

Figure 1:
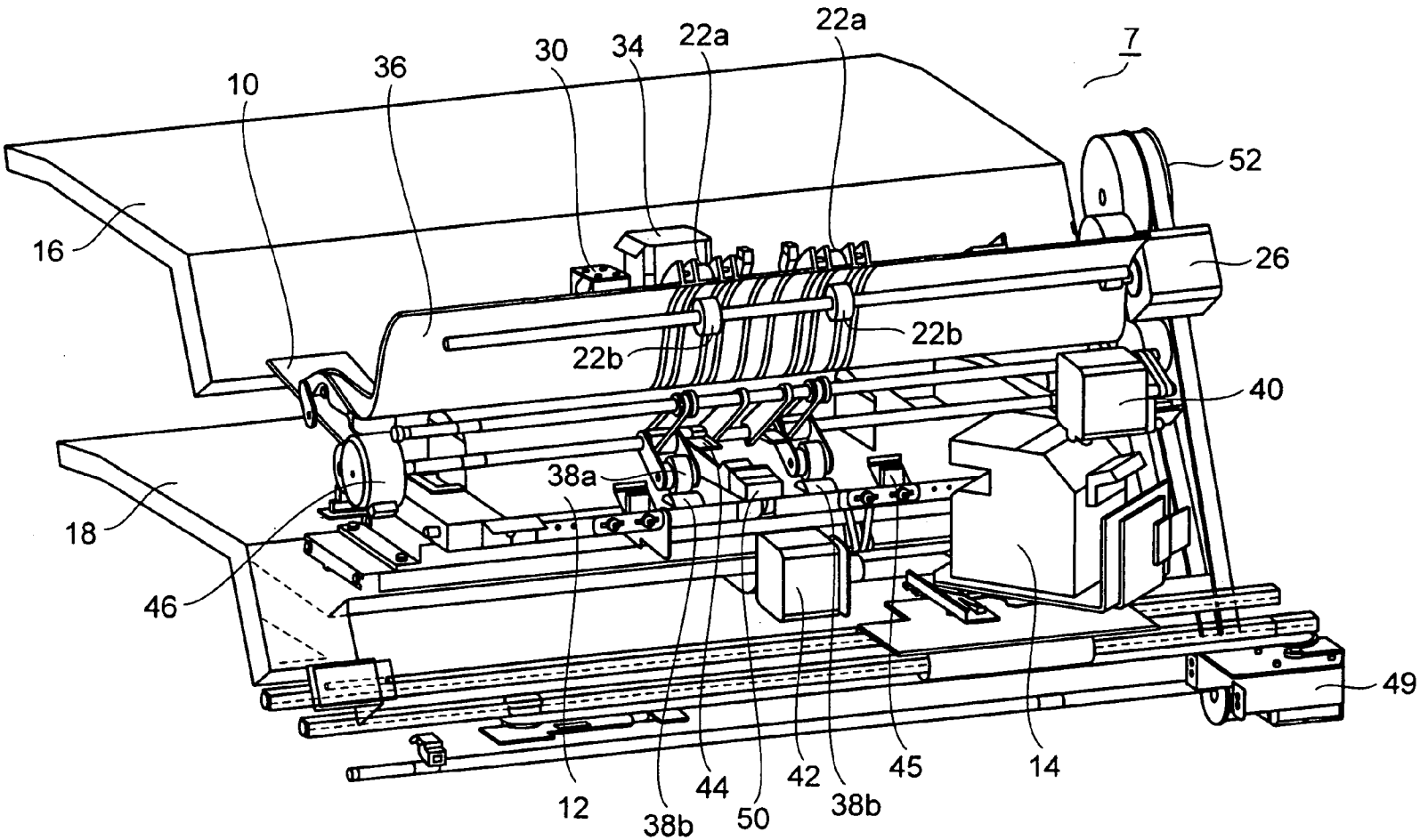
FIG. 1 is a perspective view showing the essential section of the sheet post-process apparatus of the embodiment of the present invention.
Figure 2:
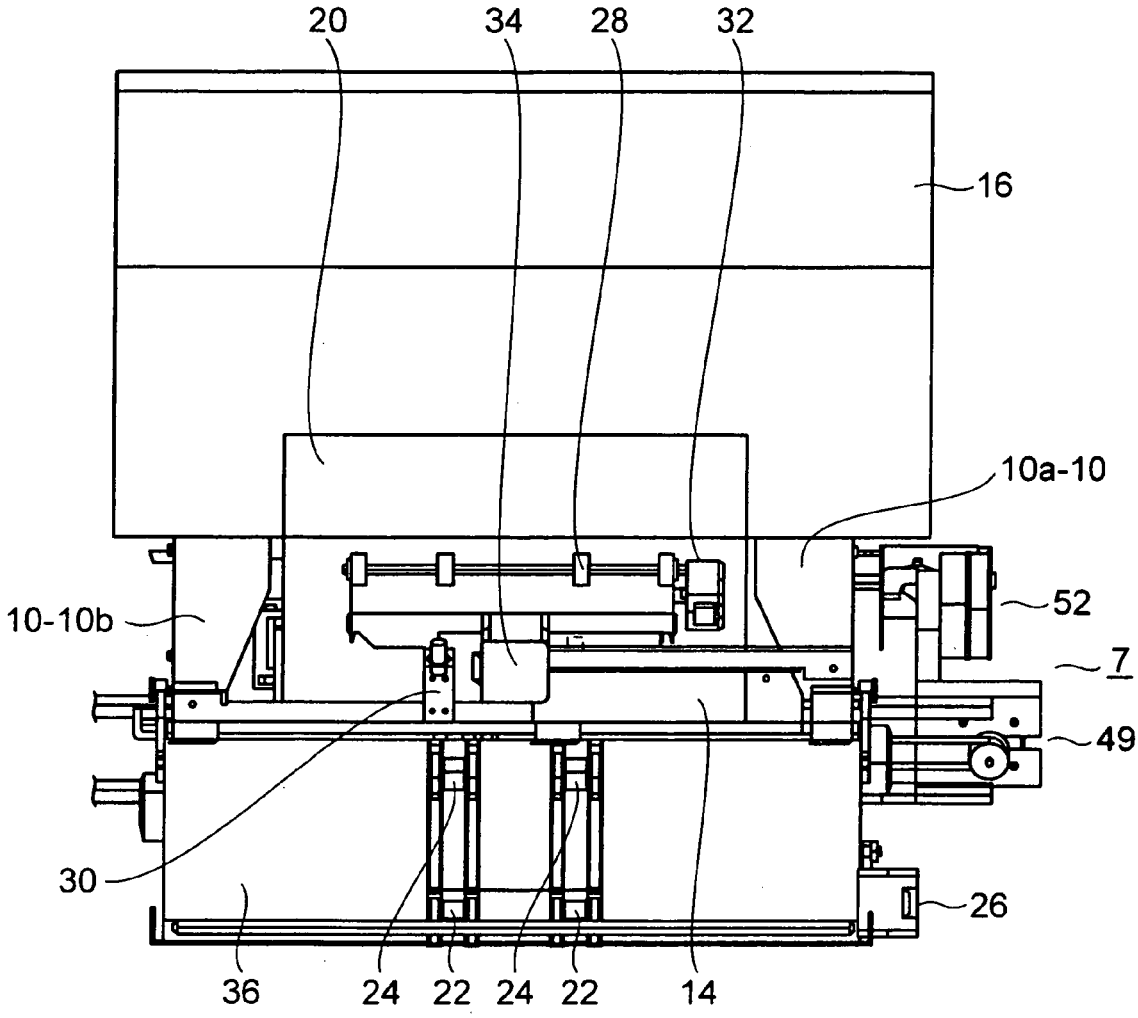
FIG. 2 is a top view showing the essential section of the sheet post-process apparatus of the embodiment of the present invention.
Figure 3:
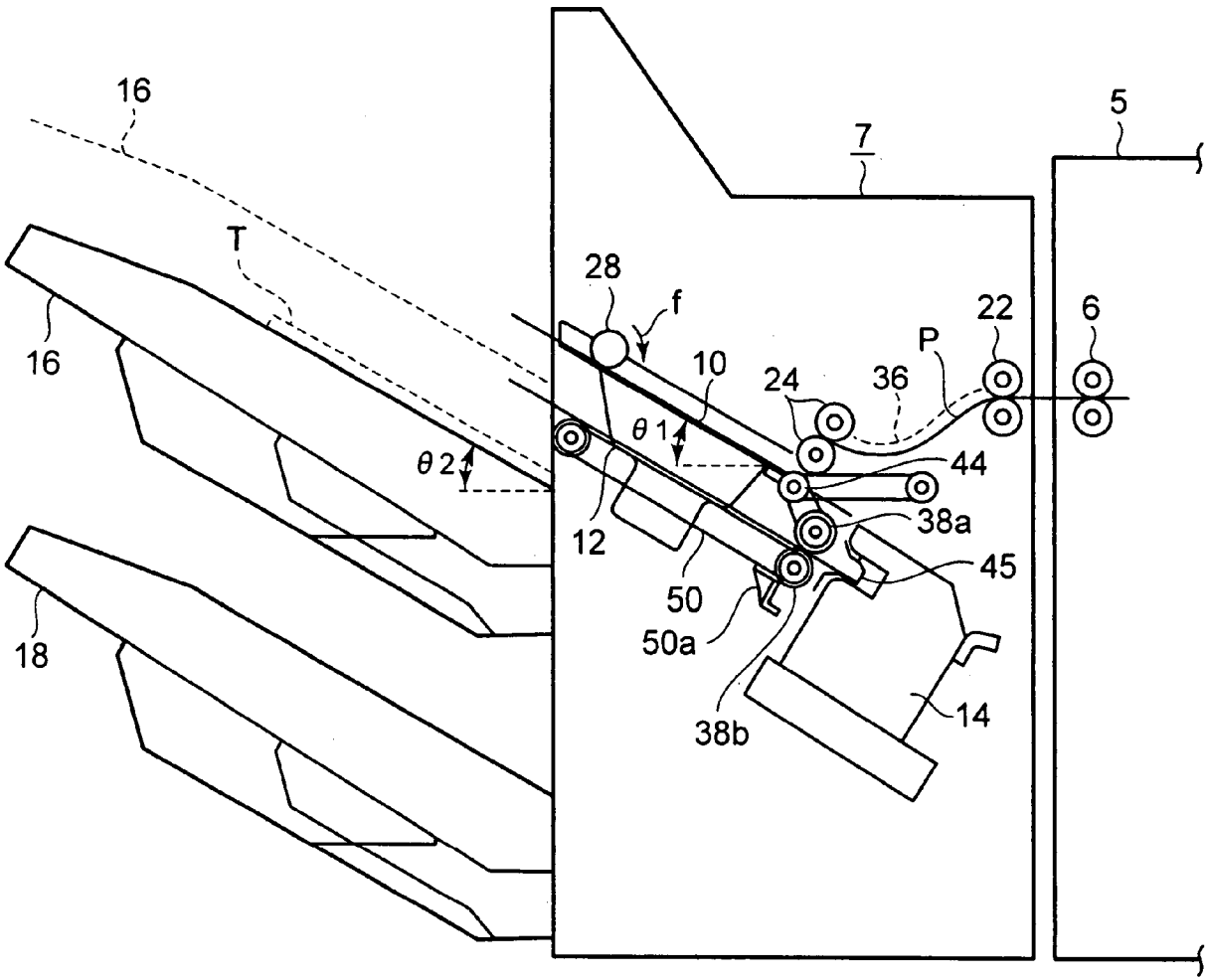
FIG. 3 is a schematic block diagram showing the sheet post-process apparatus of the embodiment of the present invention.

Hereinafter, the embodiment of the present invention will be explained in detail with reference to the accompanying drawings. FIG. 1 is a perspective view showing the essential section of a sheet post-process apparatus 7 of the embodiment of the present invention, and FIG. 2 is a top view showing the essential section of the sheet post-process apparatus, and FIG. 3 is a schematic block diagram showing the sheet post-process apparatus 7 arranged in the neighborhood of an image forming apparatus 5 such as a copier. The sheet post-process apparatus 7 has a pair of entrance rollers 22 for fetching a sheet of paper P on which an image is formed by the image forming apparatus 5 and which is ejected by a pair of paper ejection rollers 6 into the sheet post-process apparatus 7. The entrance rollers 22 are driven by an entrance roller motor 26. Between the entrance rollers 22 and a standby tray 10 which is a standby means, a paper path ceiling 36 for leading the sheets of paper P to a pair of paper feed rollers 24 is installed. Under the standby tray 10, a processing tray 12 which is a loading means for loading the sheets of paper P dropped and fed from the standby tray 10 is arranged.

Figure 4:
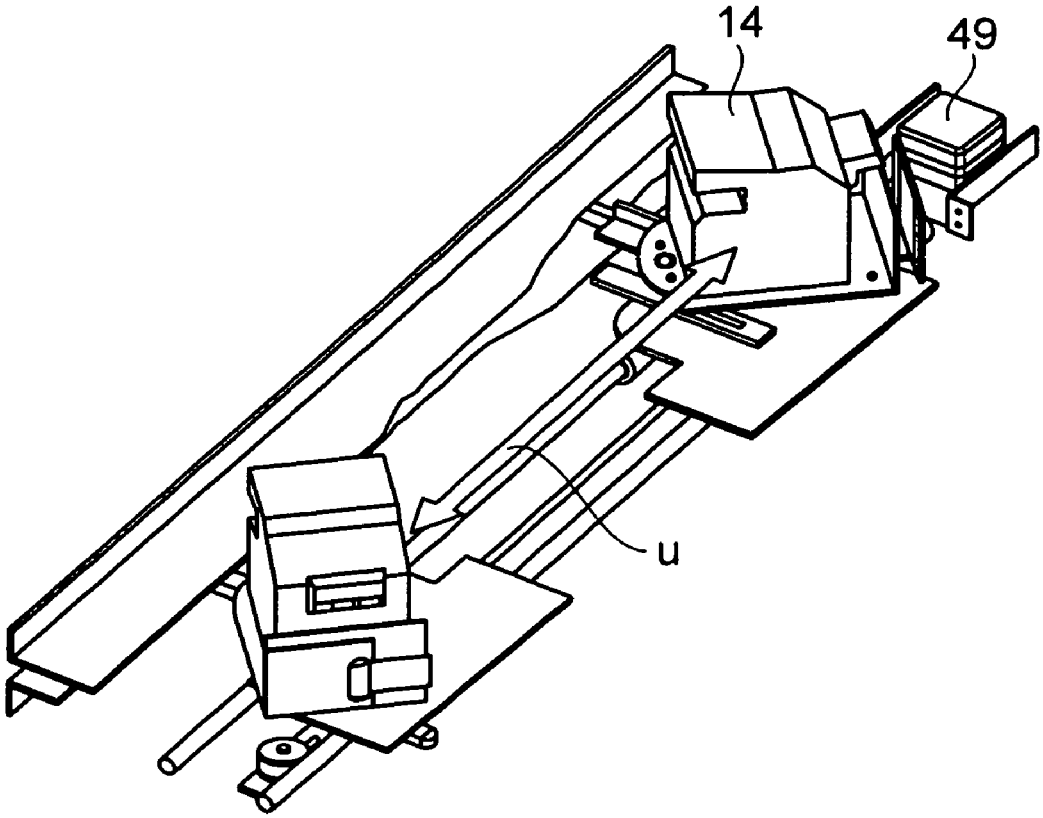
FIG. 4 is a perspective view showing the stapler of the sheet post-process apparatus of the embodiment of the present invention.

The processing tray 12, while the sheets of paper P are stapled by the stapler 14 which is a processing mechanism for performing the post-process, matches and supports the sheets of paper P to be loaded. As shown in FIG. 4, the stapler 14 can slide and move in the direction of the arrow u by a stapler driving unit 49. The stapler 14 is rotated, moved, and positioned according to the stapling direction, thus the stapling process is controlled.

Figure 5:
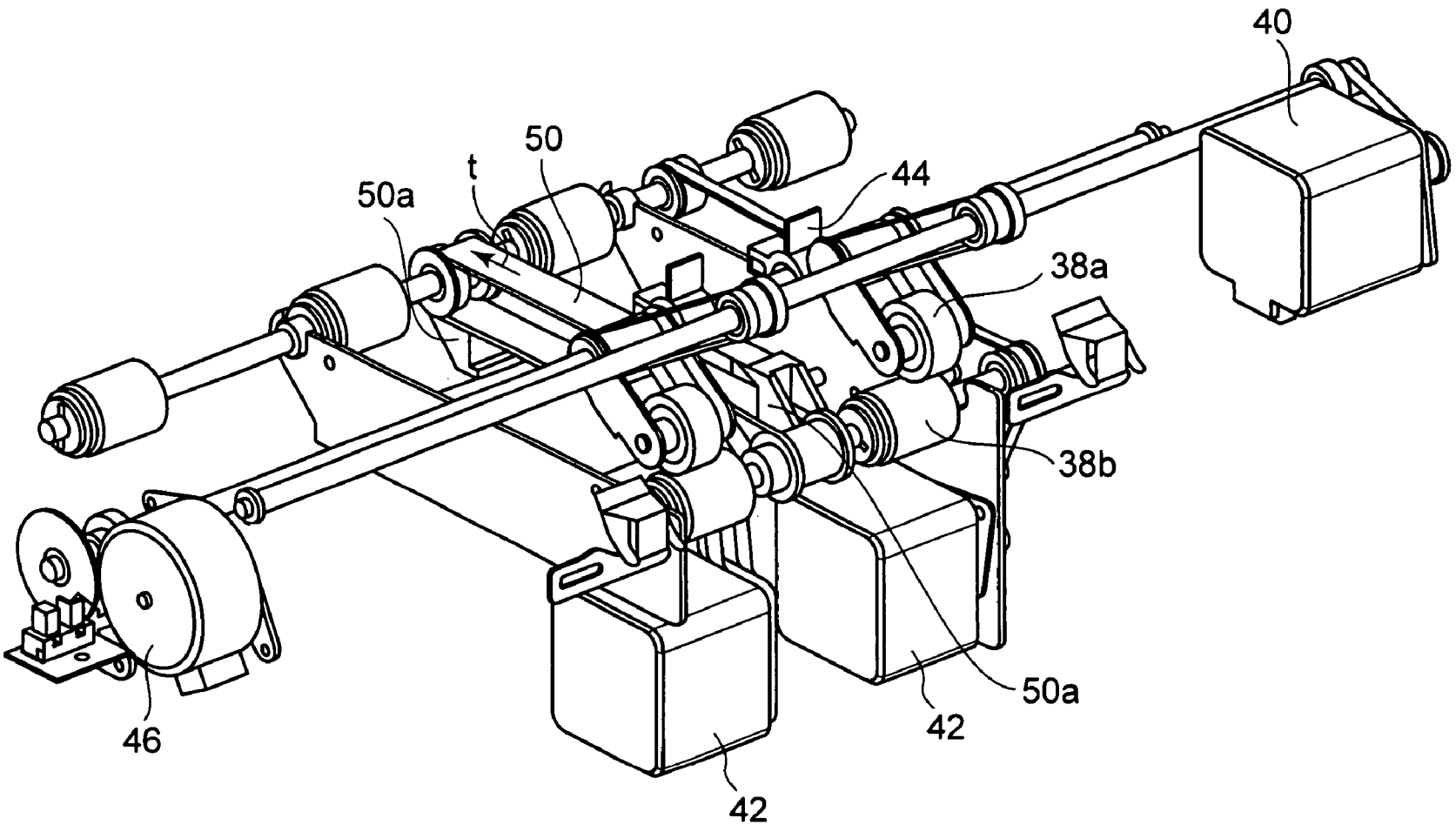
FIG. 5 is a perspective view showing the vertical matching roller of the embodiment of the present invention.

The processing tray 12 has a pair of upper vertical matching roller 38*a* and lower vertical roller 38*b* shown in FIG. 5. The upper vertical matching roller 38*a* and lower vertical roller 38*b* match a plurality of sheets of paper P dropped and fed from the standby tray 10 in the vertical direction which is a conveying direction. The upper and lower vertical matching rollers 38*a* and 38*b* serve as bundle conveying rollers for holding a sheet bundle T after stapled and taking out it from the stapler 14. The upper vertical matching roller 38*a* is driven by a vertical matching upper roller motor 40 and the lower vertical matching roller 38*b* is driven by a vertical matching lower roller motor 42.

Figure 6:
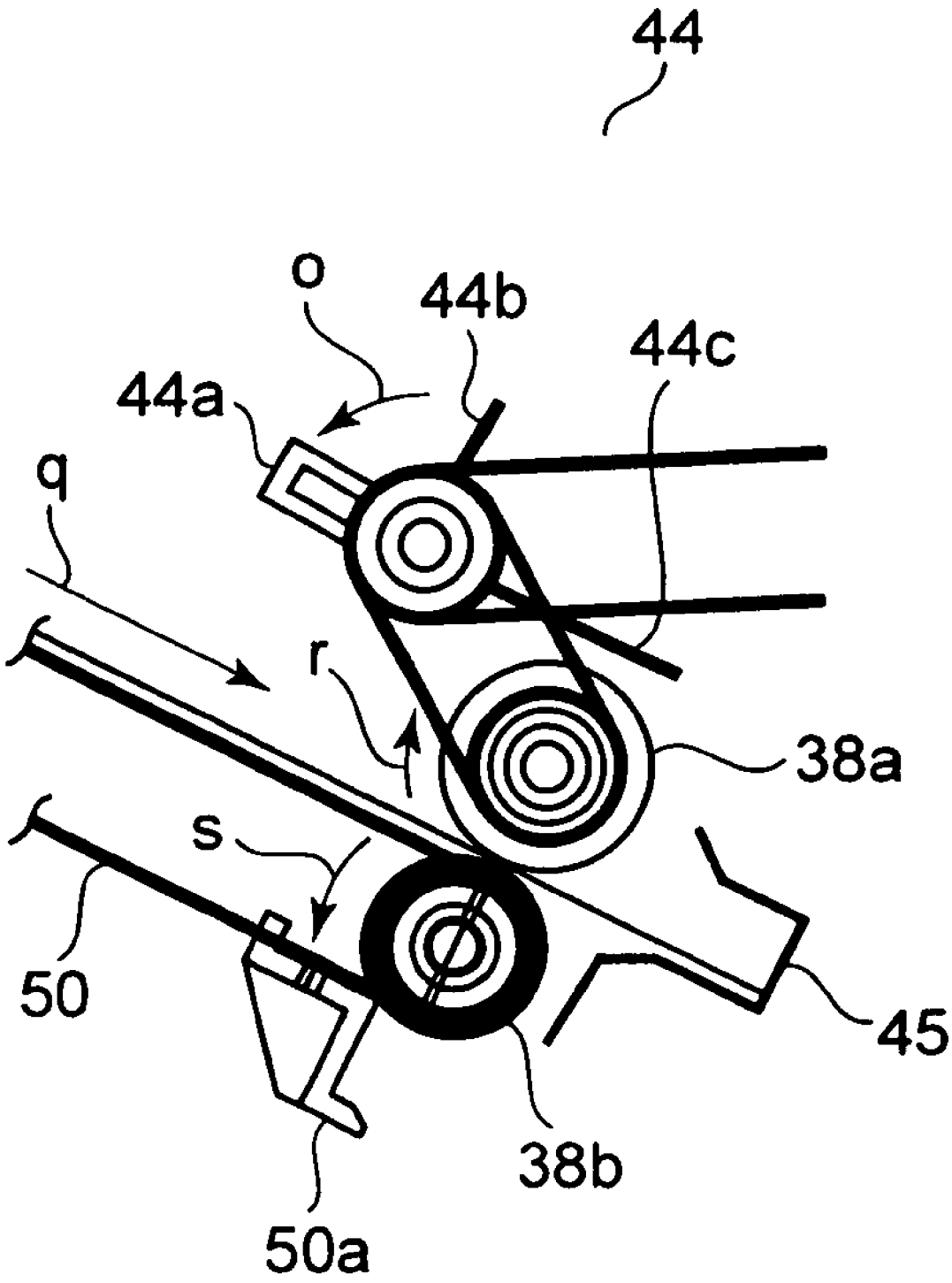
FIG. 6 is an illustration showing the paddle of the embodiment of the present invention.

Further, when the sheets of paper P are dropped and fed on the processing tray 12, at the position where the rear end of each of the sheets of paper P is dropped, a rotatable paddle 44 for matching vertically the uppermost sheet of paper P loaded on the processing tray 12 is arranged. The paddle 44, as shown in FIG. 6, has a receiving portion 44*a* of the sheets of paper P dropped and fed onto the processing tray 12, a beating portion 44*b* for beating down the sheets of paper P on the processing tray 12, and a feeding portion 44*c* for matching the sheets of paper P on the processing tray 12 and it is driven by a paddle motor 46. The paddle 44 is composed of an elastic rubber material.

At the end of the processing tray 12 on the side of the stapler 14, a stopper 45 for making contact with the rear end of each of the sheets of paper P and controlling the rear end position. Almost at the center of the processing tray 12, a conveyor belt 50 which is a conveyor mechanism for making contact with the lowest sheet of paper P on the processing tray 12 is installed. The conveyor belt 50 conveys the sheet bundle T, which is stapled and taken out from the stapler 14 by the upper and lower vertical matching rollers 38*a* and 38*b*, up to the first or second paper ejection tray 16 or 18 which is a paper ejection means. To the conveyer belt 50, a feed pawl 50*a* for hooking the rear end of the sheet bundle T is attached.

The standby tray 10 can drop and feed the sheets of paper P onto the processing tray 12 and also can convey the sheets of paper P toward the first or second paper ejection tray 16 or 18. When conveying the sheets of paper P toward the paper ejection trays 16 and 18, a standby tray roller 28 for matching the sheets of paper P makes contact with the sheets of paper P on the standby tray 10. The standby tray roller 28 is controlled in the vertical movement by a standby tray roller driving source 30 and is driven to rotate by a standby tray roller motor 32.

The standby tray 10, to support the sheets of paper P in a state that the front ends of the sheets of paper P are positioned higher than the rear ends thereof, is arranged so that the tilt angle θ1 becomes 40°. The first or second paper ejection tray 16 or 18 is moved up and down by a paper ejection tray driving unit 52 and either of them is selected. The first or second paper ejection tray 16 or 18 is moved up and down up to almost the same height as that of the standby tray 10 or the processing tray 12 when loading the sheets of paper P to improve the consistency of the sheets of paper P to be ejected.

Further, the first or second paper ejection tray 16 or 18, to support the sheets of paper P in a state that the front ends of the sheets of paper P are positioned higher than the rear ends thereof, is arranged so that the tilt angle θ2 becomes 25°. Further, the processing tray 12, to increase the consistency of the sheets of paper P when the post process is performed by a stapler 14, is arranged so that the tilt angle θ3 becomes 30° so as to support the sheets of paper P in a state that the front ends of the sheets of paper P are positioned higher than the rear ends thereof. Here, the tilt angles θ2 and θ3, if they are not a resistance at the time of conveying of the sheets of paper P, for example, θ2=θ3 is acceptable. However, when θ3>θ2, the conveying resistance of the sheets of paper P is reduced more and the consistency can be improved. Therefore, the tilt angles θ2 and θ3 are desirable to have a relation of θ3≧θ2.

Furthermore, the standby tray 10, the processing tray 12, and the first and second paper ejection trays 16 and 18 are set so that the tilt angle θ1 of the standby tray 10, the tilt angle θ3 of the processing tray 12, and the tilt angle θ2 of the paper ejection trays 16 and 18 have a relative relation of θ1>θ3≧θ2. The reason is to increase the consistency of the sheets of paper P on the processing tray 12 and the first and second paper ejection trays 16 and 18.

For example, assuming the tilt angle θ1 of the standby tray 10 and the tilt angle θ2 of the first paper ejection tray 16 as θ1<θ2, the friction between the front end of the sheet of paper P starting to enter the first paper ejection tray 16 and the first paper ejection tray 16 is increased. Namely, the ejection force of the front end of the sheet of paper P is decreased, and the sheet of paper P is curved convexly as indicated by the dotted line in FIG. 10, and there is a possibility that the consistency of the sheet of paper P after ejection may be decreased, and the sheet of paper P may be damaged due to defective paper ejection as well.

Therefore, the tilt angle θ1 of the standby tray 10 and the tilt angle θ2 of the first paper ejection tray 16 are set as θ1>θ2 and the front end of the sheet of paper P is ejected smoothly. Similarly, the tilt angle θ3 of the processing tray 12 and the tilt angle θ2 of the first or second paper ejection tray 16 or 18 are set as θ3>θ2 and the front end of the sheet of paper P ejected from the processing tray 12 is ejected smoothly.

Further, when dropping the sheets of paper P from the standby tray 10 onto the processing tray 12, compared with dropping the whole sheets of paper P almost in parallel with the processing tray, when the sheets of paper P are dropped from the ends on the side of the stapler 14, the consistency of the sheets of paper on the processing tray 12 is good and the sheets of paper P are lined up easily on the side of the stapler 14. Therefore, the tilt angle θ1 of the standby tray 10 and the tilt angle θ3 of the processing tray 12 are set as θ1>θ3, and the consistency of the stapler 14 is increased, and a satisfactory stapling process is performed.

Figure 7:
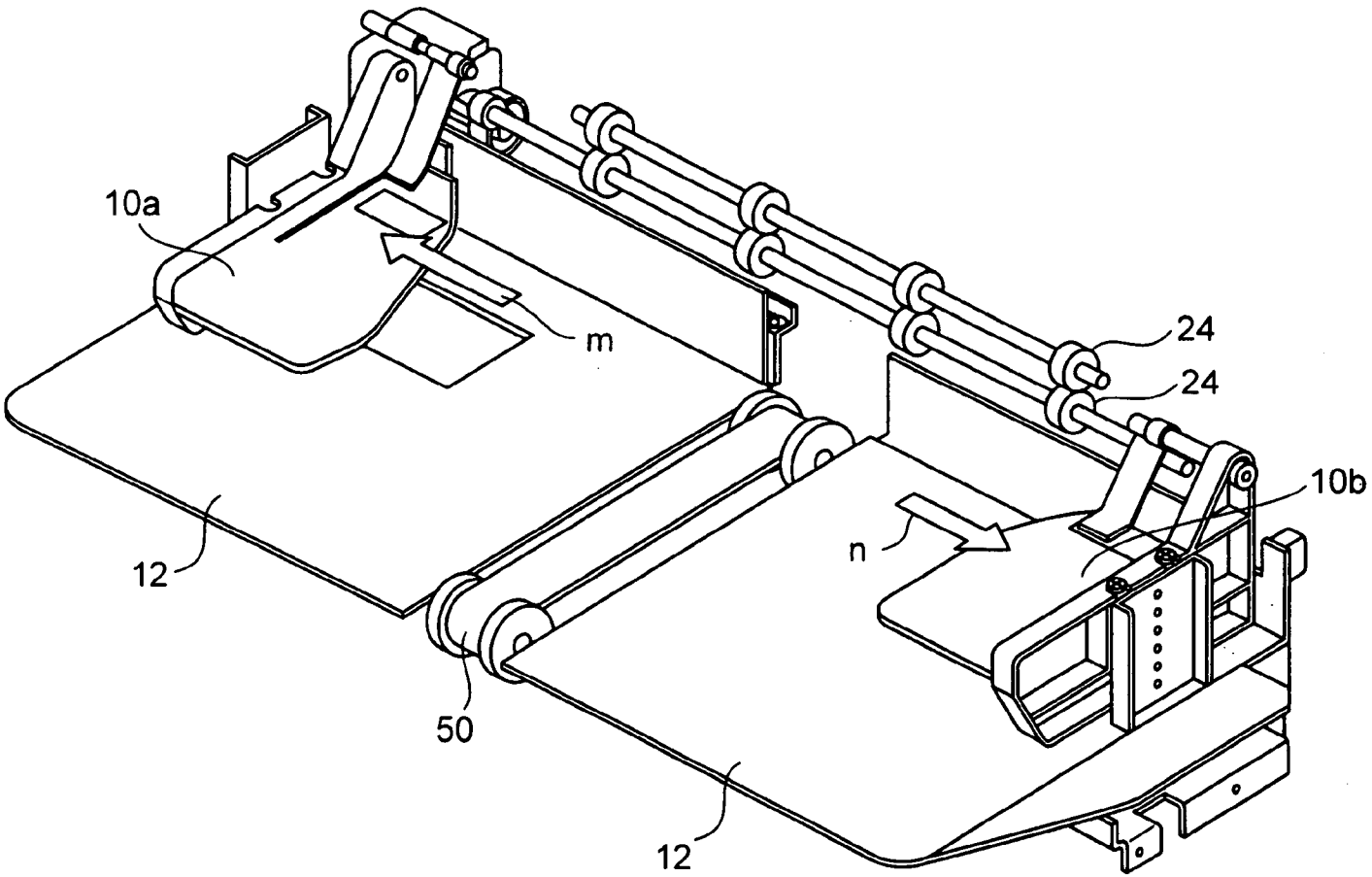
FIG. 7 is a schematic perspective view showing the standby tray and processing tray of the embodiment of the present invention.
Figure 8:
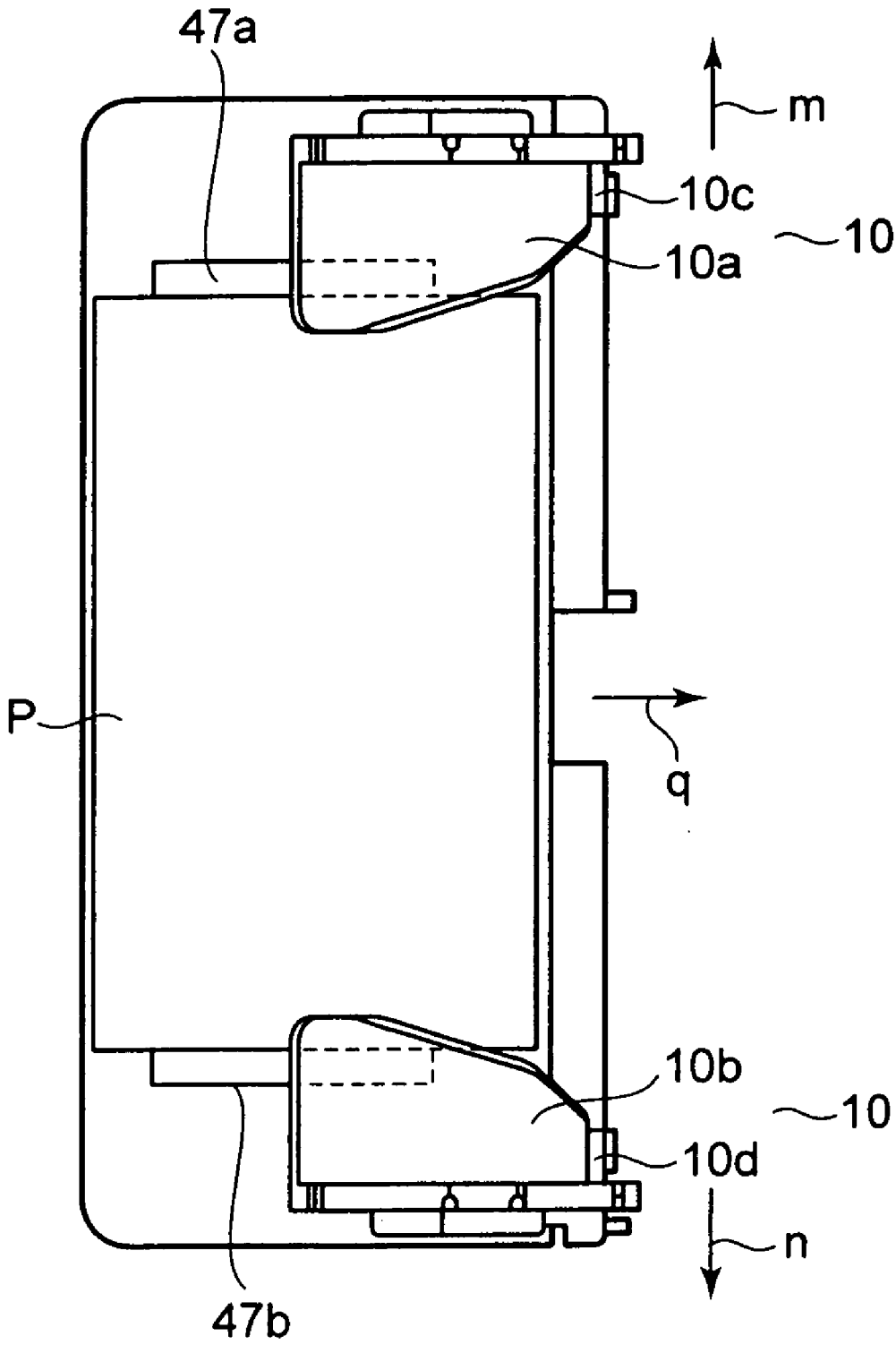
FIG. 8 is a top view showing the standby tray and processing tray of the embodiment of the present invention.
Figure 9:
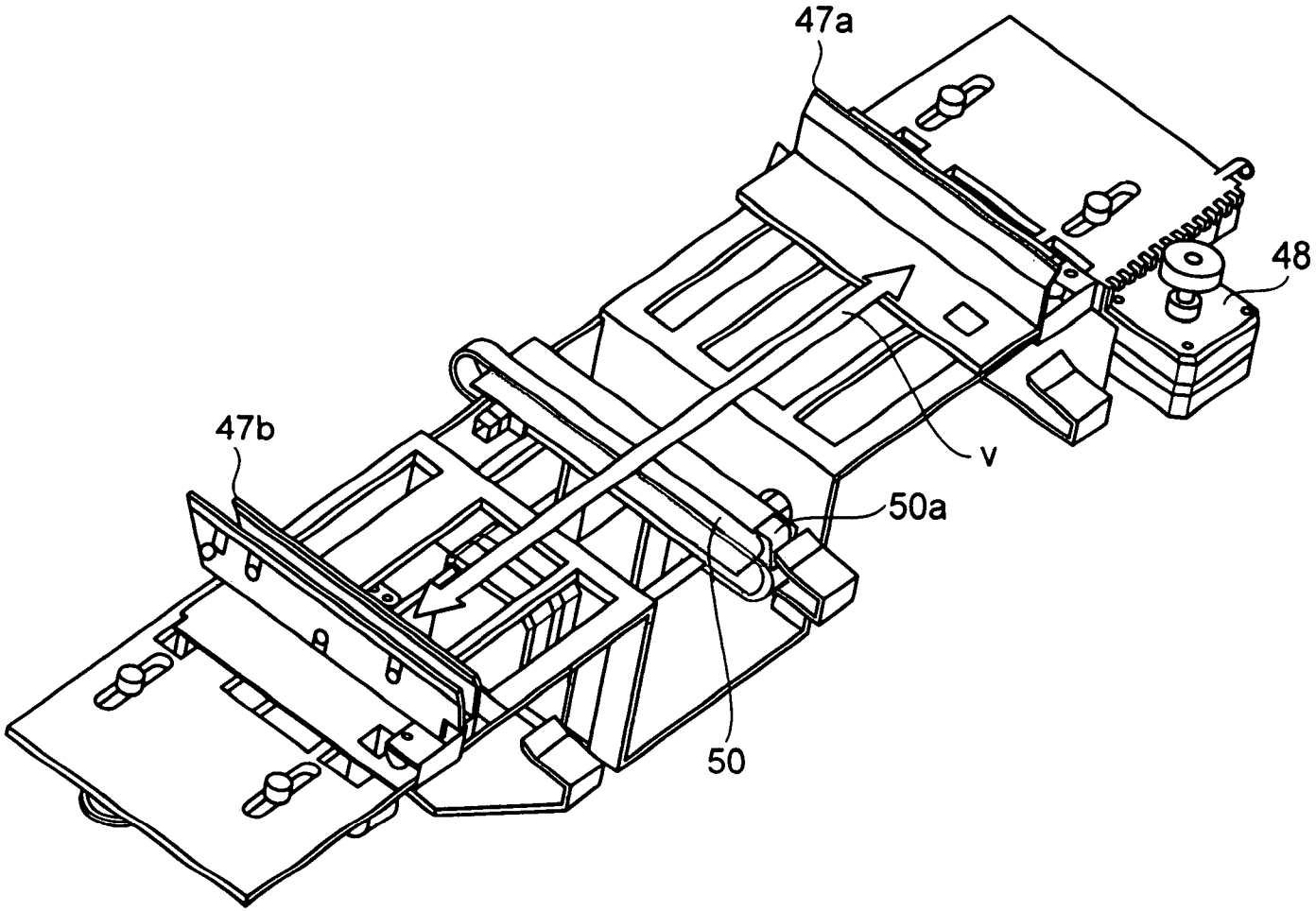
FIG. 9 is a schematic perspective view showing the horizontal matching plate and conveyor belt of the embodiment of the present invention.

As shown in FIGS. 7 and 8, the standby tray 10 has a pair of tray members 10*a* and 10*b*, receives the sheets in a state that it slides in the width of the paper P and supports both sides of the paper P. On the tray members 10*a* and 10*b*, standby stoppers 10*c* and 10*d* for controlling the rear ends of the sheets of paper P are installed. The standby tray 10 slides and moves by the standby tray motor 34. Between the standby tray 10 and the processing tray 12 where it reaches, when dropping and feeding the sheets of paper P from the standby tray 10 onto the processing tray 12, horizontal matching plates 47*a* and 47*b* shown in FIG. 9 for preventing the sheets of paper P from turning away in the horizontal direction perpendicular to the conveying direction and matching them horizontally are installed. The horizontal matching plates 47*a* and 47*b* are formed slidably in the direction of the arrow v so as to fit to the width of the sheets of paper P by a horizontal matching motor 48.

Next, the operation of the invention will be described. When an image is formed by the image forming apparatus 5 and a sheet of paper P is fed from the paper ejection rollers 6, the sheet post-process apparatus 7, depending on a case of performing the post-process of the sheet of paper P or a case of performing no post-process, or while the preceding sheet of paper P is in execution of the post-process or the post-process is finished, performs a different operation.

When the post-process is not to be performed, for example, the first paper ejection tray 16 slides and moves to the position indicated by a dotted line shown in FIG. 3 and can load the sheets of paper P ejected from the standby tray 10 in good consistency. When the post-process is not to be performed, the sheet of paper 10 conveyed from the entrance rollers 22 to the paper feed rollers 24 via the paper path ceiling 36 is fed to the standby tray 10 by the paper feed rollers 24. Then, the sheet of paper P is moved down onto the standby tray 10, is conveyed by the standby tray 28 rotating in the direction of an arrow f, and is ejected to the first paper ejection tray 16.

In this way, on the first paper ejection tray 16, sheets of paper are sequentially loaded. At this time, the tilt angle θ1 of the standby tray 10 and the tilt angle θ2 of the first paper ejection tray 16 are set as θ1>θ2, so that when the paper ejection is started, the conveying force of the front ends of the sheets of paper P is not decreased due to the friction with the first paper ejection tray 16 and the sheets of paper P are smoothly ejected free of bending.

Figure 10:
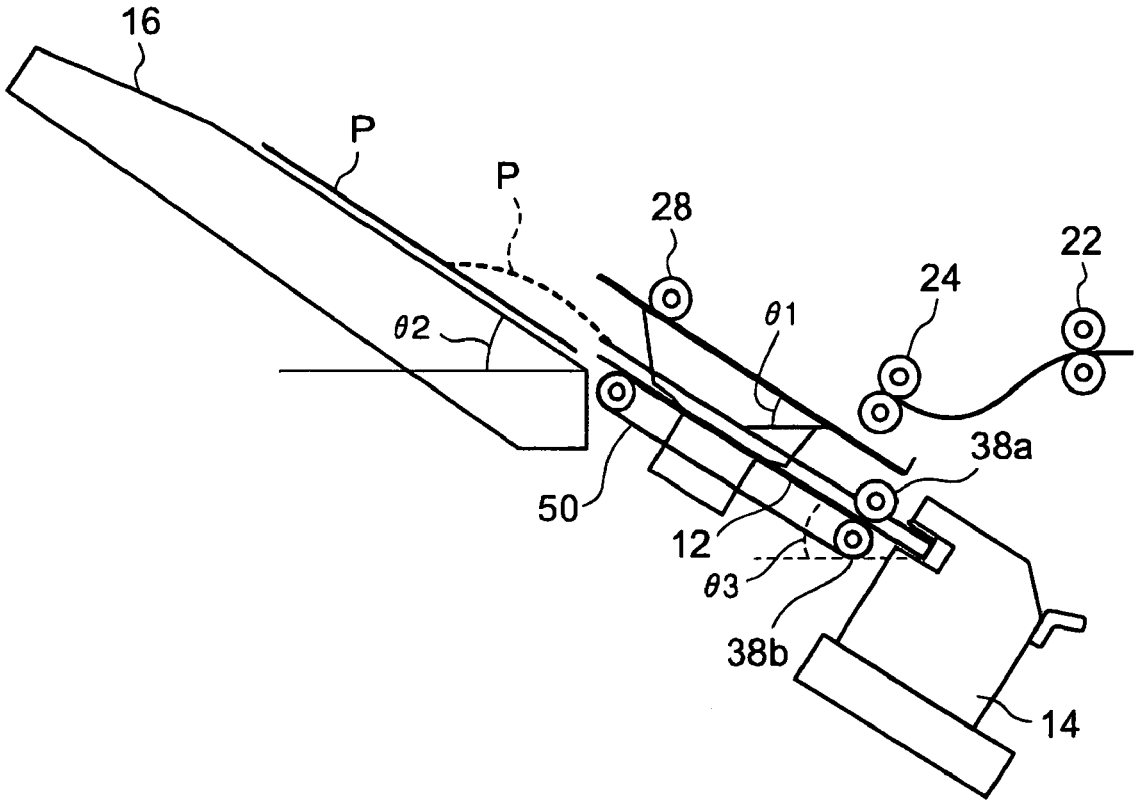
FIG. 10 is an illustration showing a state that the sheets of paper on the standby tray or paper ejection tray of the embodiment of the present invention are pressed out.

Furthermore, at this time, the first paper ejection tray 16 is arranged so that the tilt angle becomes θ2, and the front ends of the sheets of paper are positioned higher than the rear ends thereof, so that for example, even if the sheets of paper P are ejected onto the first paper ejection tray 16 in a state that they are curled convexly as indicated by the dotted line in FIG. 10, the preceding sheets of paper P loaded on the first paper ejection tray 16 are not pressed out by making contact with the front ends of the succeeding sheets of paper P. Namely, the ejected sheets of paper P are sequentially loaded on the first paper ejection tray 16 unless the order is disturbed. Further, even if the preceding sheet of paper P is pressed by the succeeding sheet of paper P and is slightly displaced, since the tilt angle θ2 is formed, the sheet of paper P drops by its own weight and is loaded on the first paper ejection tray 16 with the rear end matched, and the ejection process of the sheets of paper is completed.

Next, a case that the stapling process which is a post process is to be performed and no preceding sheet of paper P in execution of the stapling process exists on the processing tray 12 will be described. At this time, the standby tray 10 slides and moves the tray members 10*a* and 10*b* respectively up to the positions indicated by the dotted lines in FIG. 11 in the directions of arrows m and n and opens the dropping and feeding path of the sheet of paper P. Further, the horizontal matching plates 47*a* and 47*b*, to match the sheet of paper P dropping from the paper feed rollers 24 in the horizontal direction, are arranged so that the gap between the horizontal matching plates 47*a* and 47*b* is made almost equal to the width of the sheet of paper P. By doing this, the sheet of paper P fed by the paper feed rollers 24, without the conveying being obstructed by the standby tray 10, is dropped and fed directly onto the processing tray 12.

At the time of dropping and feeding, the upper vertical matching roller 38*a* is shifted upward and the receiving portion 44*a* of the paddle 44 receives the rear end of the sheet of paper P. Both sides of the sheet of paper P drop in contact with the horizontal matching plates 47*a* and 47*b* and are matched in the horizontal direction. When the sheet of paper P is dropped from the standby tray 10 onto the processing tray 12, the tilt angle θ1 of the standby tray 10 and the tilt angle θ3 of the processing tray 12 are set as θ1>θ3, so that the sheet of paper P makes contact with the processing tray 12 from the side of the stapler 14 and is fed onto the processing tray 12 in a lined-up state.

Then, the paddle 44 rotates in the direction of an arrow o, drops the rear end of the sheet of paper P from the receiving portion 44*a*, and beats down it onto the processing tray 12 by the beating portion 44*b*. Furthermore, the paddle 44 feeds the sheet of paper P in the direction of an arrow q by the feeding portion 44*c*, and the rear end of the sheet of paper P makes contact with the stopper 45, and the vertical matching of the sheet of paper P is completed. At this time, the processing tray 12 has the tilt angle θ3, so that the sheet of paper P is easily lined up on the side of the stopper 45 by the inclination. Further, the vertical matching of the sheet of paper P on the processing tray 12 may be executed by the upper vertical matching roller 38*a* by moving up and down the upper vertical matching roller 38*a* each time.

In this way, the sheet of paper P on which an image is formed is loaded directly on the processing tray 12 from the paper feed rollers 24 while sequentially matching it in the horizontal direction and vertically direction. When the sheets of paper P reach a predetermined number, the stapler 14 staples the sheets of paper P on the processing tray 12 at a desired position and bundles them to form the sheet bundle T. Hereafter, the upper vertical matching roller 38*a* is moved down onto the sheet bundle and the sheet bundle T is held between the upper vertical matching roller 38*a* rotating in the direction of the arrow r and the lower vertical matching roller 38*b* rotating in the direction of the arrow s and is conveyed toward the first paper ejection tray 16.

When the rear end of the sheet bundle T passes the upper and lower vertical matching rollers 38*a* and 38*b*, it is hooked by the feed pawl 50*a* of the conveyor belt 50 rotating in the direction of the arrow t and is fed onto the first paper ejection tray 16.

At this time, the first paper ejection tray 16 slides and moves from the position indicated by the dotted line in FIG. 3 to the position indicated by the solid line. Further, the tilt angle θ3 of the processing tray 12 and the tilt angle θ2 of the first paper ejection tray 16 are set as θ3≧θ2. Therefore, when the paper ejection is started, the conveying force of the front end of the sheet bundle T is not decreased due to the friction with the first paper ejection tray 16 and the sheet bundle T is smoothly ejected. Further, the first paper ejection tray 16 is arranged so that the tilt angle becomes θ2 and the front ends of the sheets of paper are positioned higher than the rear ends thereof. Therefore, the preceding sheet of paper P fed onto the first paper ejection tray 16 is not pressed out by making contact with the front end of the succeeding sheet bundle T. Further, even if the preceding sheet bundle T is pressed by the succeeding sheet of paper P and is slightly displaced, since the first paper ejection tray 16 has the tilt angle θ2, the sheet bundle T drops by its own weight and is loaded on the first paper ejection tray 16 with the rear end matched, and the stapling process of the sheets of paper P is completed.

Next, a case that the stapling process which is a post-process is to be performed and preceding sheets of paper P in execution of the stapling process remain on the processing tray 12 will be described. At this time, in the standby tray 10, the tray members 10*a* and 10*b* slide and move from the positions indicated by the dashed lines in FIG. 11 respectively in the opposite direction of the direction of the arrow m or in the opposite direction of the direction of the arrow n, and are at the positions indicated by the solid lines shown in FIG. 11, and can support the sheet of paper P. Further, the standby tray roller 28 is shifted above the standby tray 10 not to disturb the sheets of paper P. The sheets of paper P ejected from the image forming apparatus 5 and fed by the paper feed rollers 24 are loaded once on the standby tray 10 to wait for the processing tray 12 to be free.

The sheets of paper P loaded on the standby tray 10 are moved down onto the standby tray 10, are sent toward the standby stoppers 10*c* and 10*d* by the standby tray roller 28 rotating in the opposite direction of the direction of the arrow f, and are vertically matched with the rear end of the sheets of paper P in contact with the standby stoppers 10*c* and 10*d*. Furthermore, the first paper ejection tray 16 is arranged slantwise so that the front end of the sheets of paper is positioned higher than the rear end thereof, thus the sheets of paper P are vertically matched by the own weight with the rear end thereof in contact with the standby stoppers 10*c* and 10*d*.

The standby tray 10 is arranged slantwise, so that for example, even if the sheet of paper P is fed from the paper feed rollers 24 in a state that it is curled convexly and is fed to the standby tray 10, the preceding sheet of paper P loaded on the standby tray 10 is not pressed out by making contact with the front end of the succeeding sheet of paper P.

Namely, the fed sheets of paper P are sequentially loaded on the standby tray 10 unless the order is disturbed. Further, even if the preceding sheet of paper P is pressed by the succeeding sheet of paper P and is slightly displaced, since the standby tray 10 has the tilt angle θ1, the sheet of paper P drops by its own weight down to the position where the rear end thereof makes contact with the standby stoppers 10*c* and 10*d* and is loaded on the standby tray 10 with the rear end matched.

Figure 11:
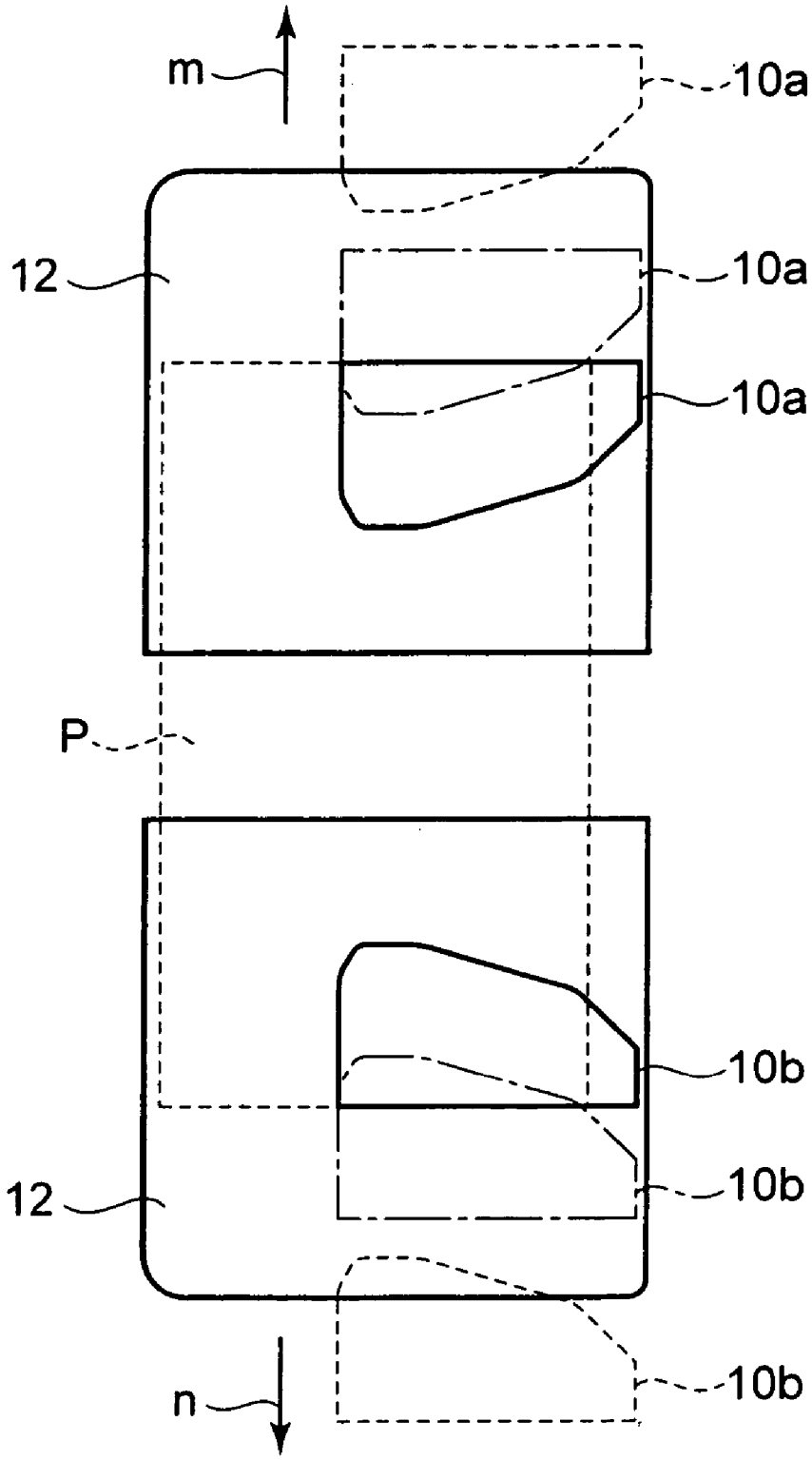
FIG. 11 is an illustration showing movement of the standby tray of the embodiment of the present invention.

During this period, when the preceding sheet of paper P on the processing tray 12 is ejected on the side of the paper ejection tray 16 and the processing tray 12 becomes free, the standby tray 10 slides and moves the tray members 10*a* and 10*b* respectively up to the positions indicated by the dotted lines in FIG. 11 in the directions of the arrows m and n from the positions indicated by the solid lines in FIG. 11 via the positions indicated by the alternate long and short dash line in FIG. 11. By doing this, for example, two sheets of paper P standing by on the standby tray 10, when the tray members 10*a* and 10*b* reach the positions indicated by the alternate long and short dash line in FIG. 11, are dropped and fed onto the processing tray 12 from between the tray members 10*a* and 10*b*. At this time, the horizontal matching plates 47*a* and 47*b* are arranged so as to make the interval between them almost equal to the width of the sheets of paper P. Therefore, the sheets of paper P dropped from the standby tray 10 are controlled on both sides by the horizontal matching plates 47*a* and 47*b* and are matched horizontally.

The lower side sheet of paper P of the two sheets of paper P dropped onto the processing tray 12 is sent in the direction of the arrow q by the lower vertical matching roller 38*b* rotating in the opposite direction of the direction of the arrow s, and the rear end of the sheet of paper P makes contact with the stopper 45, and the vertical matching of the sheet of paper P is completed. The upper side sheet of paper P of the two sheets of paper P dropped onto the processing tray 12 is sent in the direction of the arrow q by the upper vertical matching roller 38*a* rotating in the opposite direction of the direction of the arrow r. By doing this, the rear end of the sheet of paper P makes contact with the stopper 45 and the vertical matching of the sheet of paper P is completed. Thereafter, the upper vertical matching roller 38*a* is shifted upward.

The third and subsequent sheets of paper P ejected from the image forming apparatus 5 are directly dropped and fed onto the processing tray 12 from between the tray members 10*a* and 10*b* without standing by on the standby tray 10. Hereafter, the third and subsequent sheets of paper P are sequentially matched on the sheets of paper P loaded earlier on the processing tray 12 by the paddle 44.

When the sheets of paper P loaded on the processing tray 12 reach a predetermined number, the sheets are stapled by the stapler 14 to form the sheet bundle T. Hereafter, the sheet bundle T is conveyed toward the first paper ejection tray 16 by the upper and lower vertical matching rollers 38*a* and 38*b*, and furthermore the rear end is hooked by the feed pawl 50*a* of the conveyor belt 50 and is conveyed to the first paper ejection tray 16, and the stapling process of the sheets of paper P is completed.

According to this embodiment, when the stapling process is to be performed after image forming and the preceding stapling process is not finished on the processing tray 12, the standby tray 10 is installed above the processing tray 12 and waits for the succeeding sheets of paper P. And, waiting for the processing tray 12 to become free, the sheets of paper P standing by on the standby tray 10 are dropped and fed and then are moved to the processing tray 16. Therefore, the practical conveying path from the standby tray 10 in the sheet post-process apparatus 7 to the processing tray 12 can be shortened and the sheet post-process apparatus can be miniaturized.

Further, the standby tray 10 has the tilt angle θ1, so that the sheets of paper P can be matched by the own weight on the standby tray 10. Furthermore, there are no possibilities that the preceding loaded sheet of paper P is pressed out by the succeeding sheet of paper P and the consistency of the sheets of paper P on the standby tray 10 can be improved. Therefore, the sheets of paper P can be prevented from jamming and moreover the sheets of paper P on the standby tray 10 can be prevented from disturbance of the loading order. Similarly, the first and second paper ejection trays 16 and 18 are given the tilt angle θ2, thus there are no possibilities that the preceding loaded sheet of paper P or sheet bundle T is pressed out by the succeeding sheet of paper P or sheet bundle T and the consistency of the sheets of paper P on the first or second paper ejection tray 16 or 18 can be improved. Therefore, the sheets of paper P can be prevented from jamming and moreover the sheets of paper P or sheet bundle T on the first or second paper ejection tray 16 or 18 can be prevented from disturbance of the loading order.

Further, the processing tray 12 is given the tilt angle θ3, so that the consistency of the sheets of paper P when fed to the stapler 14 is high and a satisfactory stapling process can be obtained. Furthermore, the tilt angle θ1 of the standby tray 10, the tilt angle θ3 of the processing tray 12, and the tilt angle θ2 of the paper ejection trays 16 and 18 have a relation of $\theta 1 > \theta 3 \geqq \theta 2$, so that the consistency at the time of dropping and feeding from the standby tray 10 onto the processing tray 12, the consistency at the time of paper ejection from the standby tray 10 onto the first paper ejection tray 16, and the consistency at the time of paper ejection from the processing tray 12 onto the paper ejection trays 16 and 18 are all improved. Therefore, on the standby tray 10 and the processing tray 12 in the middle, satisfactory consistency can be retained and the sheets of paper P or sheet bundle T post-processed in high consistency on the paper ejection trays 16 and 18 can be obtained as well.

Further, the present invention is not limited to the aforementioned embodiment and can be variously modified within the scope of the present invention. For example, the method for dropping and feeding sheets from the standby tray onto the processing tray is not limited and the standby tray rotates and moves instead of sliding and moving, thus sheets of paper on the standby tray may be dropped and fed onto the processing tray. Further, the processing mechanism, if it is a post process to be performed for sheets, is not limited to the stapler and it may be a hole puncher. Furthermore, the tilt angle θ1 of the standby tray, the tilt angle θ2 of the paper ejection trays, and the tilt angle θ3 of the processing tray are not limited and the relative angle thereof, so long as the relation of θ1>θ3≧θ2 is retained, is not limited.

Furthermore, the standby tray is given the tilt angle θ1 so that the front end of sheets is positioned higher than the rear end thereof and the paper ejection trays are given the tilt angle θ2 so that the front end of sheets is positioned higher than the rear end thereof, thus on the standby tray and paper ejection trays, the preceding loaded sheet is not pressed out by the succeeding sheet. Therefore, on the standby tray and paper ejection trays, the consistency of sheets is improved, and the sheets can be prevented from jamming, and the sheets on each tray can be prevented from disturbance of the loading order.

Further, the tilt angle θ1 of the standby tray and the tilt angle θ3 of the processing tray have a relation of θ1>θ3, so that when dropping sheets from the standby tray onto the processing tray, the end of each sheet on the post-process apparatus side earlier makes contact with the processing tray and then the whole makes contact with the processing tray. Therefore, the consistency of sheets when the sheets on the processing tray are fed to the post-process apparatus is excellent and the post process can be performed easily.

Since the tilt angle θ3 of the processing tray and the tilt angle θ2 of the paper ejection trays have a relation of θ3≧θ2, the contact area between the sheets and the paper ejection trays when the paper ejection from the processing tray onto the paper ejection trays is started becomes smaller. Therefore, the friction between the sheets and the paper ejection trays can be made smaller, and the conveying force of the sheets is not decreased, and satisfactory paper ejection can be obtained. Furthermore, similarly, since the tilt angle θ1 of the standby tray and the tilt angle θ2 of the paper ejection trays have a relation of θ1>θ2, even when the paper ejection from the standby tray onto the paper ejection trays is started, the friction between the sheets and the paper ejection trays can be made smaller and satisfactory paper ejection can be obtained.

What is claimed is:

1. A sheet post-process apparatus, comprising:

a standby tray that makes sheets ejected from an image forming apparatus stand by, the standby tray having a tilt angle of θ1 at which front ends of the sheets are positioned higher than rear ends of the sheets;

a processing tray arranged under the standby tray for loading the sheets dropped and fed from the standby tray and/or the sheets ejected from the image forming apparatus not via the standby tray;

a processing mechanism for post-processing the sheets loaded on the processing tray; and a paper ejection tray that loads the sheets ejected from the processing tray after being post processed, the paper ejection tray having a tilt angle of θ2 at which the front ends of the sheets are positioned higher than the rear ends of the sheets, wherein the processing tray has a tilt angle of θ3 at which the front ends of the sheets are positioned higher than the rear ends of the sheets and the tilt angle θ1 of the standby tray, the tilt angle θ3 of the processing tray, and the tilt angle θ2 of the paper ejection tray have a relation of θ1>θ3>θ2.

2. The sheet post-process apparatus according to claim 1, wherein the processing mechanism is a stapler for bundling the plurality of sheets loaded on the processing tray.

3. The sheet post-process apparatus according to claim 1, wherein the processing mechanism is a hole puncher for making a hole in the sheets loaded on the processing tray.

4. The sheet post-process apparatus according to claim 1, wherein the standby tray includes at least a pair of tray members for respectively supporting both sides of the sheets and slides and moves the tray members to drop and feed the sheets onto said the processing tray.

5. The sheet post-process apparatus according to claim 1, wherein the standby tray is composed of at least a pair of tray members for respectively supporting both sides of the sheets and rotates and moves the tray members to drop and feed the sheets onto the processing tray.

6. The sheet post-process apparatus according to claim 1, wherein the paper ejection tray loads the sheets ejected from the standby tray not via the processing tray.

7. A sheet post-process apparatus, comprising:

standby means for making sheets ejected from an image forming apparatus stand by, the standby means having a tilt angle of θ1 at which front ends of the sheets are positioned higher than rear ends of the sheets;

loading means arranged under the standby means for loading the sheets dropped and fed from the standby means and/or the sheets ejected from the image forming apparatus not via the standby means;

processing means for post-processing the sheets loaded on the loading means, and paper ejection means for loading the sheets ejected from the loading means after being post processed, the paper ejection means having a tilt angle of θ2 at which the front ends of the sheets are positioned higher than the rear ends of the sheets, wherein the loading means has a tilt angle of θ3 at which the front ends of the sheets are positioned higher than the rear ends of the sheets and the tilt angle θ1 of the standby means, the tilt angle θ3 of the loading means, and the tilt angle θ2 of the paper ejection means have a relation of θ1>θ3>θ2.

* * * * *